US006361913B1

(12) United States Patent
Pai et al.

(10) Patent No.: US 6,361,913 B1
(45) **Date of Patent: *Mar. 26, 2002**

(54) LONG LIFE PHOTORECEPTOR

(75) Inventors: Damodar M. Pai, Fairport; John F. Yanus, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/172,521

(22) Filed: Dec. 21, 1993

(51) Int. Cl.[7] ..... G03G 5/047; G03G 5/147

(52) U.S. Cl. ..... 430/58.3; 430/58.75; 430/59.6; 430/66; 430/132

(58) Field of Search ..... 430/58, 59, 66, 430/67, 132, 58.3, 58.65, 58.75, 59.6

(56) References Cited

U.S. PATENT DOCUMENTS

| | | | | | |
|---|---|---|---|---|---|
| 4,050,935 | A | | 9/1977 | Limburg et al. | 96/1 PC |
| 4,281,054 | A | | 7/1981 | Horgan et al. | 430/59 |
| 4,297,425 | A | | 10/1981 | Pai et al. | 430/58 |
| 4,457,994 | A | | 7/1984 | Pai et al. | 430/59 |
| 4,515,882 | A | | 5/1985 | Mammino et al. | 430/58 |
| 4,599,286 | A | | 7/1986 | Limburg et al. | 430/59 |
| 4,806,443 | A | * | 2/1989 | Yanus et al. | 430/59 |
| 4,871,634 | A | | 10/1989 | Limburg et al. | 430/54 |
| 5,162,183 | A | * | 11/1992 | Lindblad et al. | 430/59 |
| 5,368,967 | A | * | 11/1994 | Schank et al. | 430/59 |

FOREIGN PATENT DOCUMENTS

| | | | | |
|---|---|---|---|---|
| EP | 0473292 | * | 3/1992 | 430/67 |
| JP | 55-98754 | * | 7/1980 | 430/59 |
| JP | 55-108667 | * | 8/1980 | 430/59 |
| JP | 63-014153 | * | 1/1988 | 430/66 |
| JP | 63-050850 | * | 3/1988 | 430/66 |

OTHER PUBLICATIONS

Patent & Trademark English Language Translation of Japanese Patent 55–98754 (Pub Jul. 28, 1980).*
Patent & Trademark English Language Translation of Japanese Patent 63–14153 (Pub Jul. 4, 1986).*

* cited by examiner

*Primary Examiner*—Janis L. Dote
(74) *Attorney, Agent, or Firm*—Robert Thompson

(57) ABSTRACT

An electrophotographic imaging member comprising a substrate, a charge generating layer, a charge transport layer, and an overcoat layer comprising a small molecule hole transporting triphenylmethane having at least one hydroxy functional group and a polyamide film forming binder capable of forming hydrogen bonds with the hydroxy functional groups of the hydroxy triphenyl methane. This overcoat layer may be fabricated using an alcohol solvent. This electrophotographic imaging member may be utilized in an electrophotographic imaging process.

15 Claims, 6 Drawing Sheets

LONG LIFE PHOTORECEPTOR

BACKGROUND OF THE INVENTION

This invention relates in general to electrophotographic imaging members and, more specifically, to layered photoreceptor structures with overcoatings containing hydrogen bonded materials and processes for making and using the photoreceptors.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

A latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example in U.S. Pat. No. 4,265,990. The disclosures of this patent is incorporated herein in its entirety. Other charge transport molecules disclosed in the prior art include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilylenes, and others including those described, for example, in U.S. Pat. Nos. 4,618,551, 4,806,443, 4,935,487, and 4,956,440. The disclosures of these patents are incorporated herein in their entirety. Other charge transporting materials include polymeric arylamine compounds and related polymers described in U.S. Pat. Nos. 4,801,517, 4,806,444, 4,818,650, 4,806,443, 5,030,532, copending application Ser. No. 07/797,753, now U.S. Pat. No. 5,283,143, entitled "ELECTROPHOTOGRAPHIC IMAGING MEMBER CONTAINING ARYLAMINE TERPOLYMERS WITH CF3 SUBSTITUTED MOIETIES", to Yanus et al, filed Nov. 25, 1991 and copending application Ser. No. 08/148,818, now U.S. Pat. No. 5,356,943, to Yanus et al, entitled "ELECTROPHOTOGRAPHIC IMAGING MEMBERS CONTAINING POLYARYLAMINE POLYESTERS", mailed by Express Mail on Nov. 8, 1993, the disclosures of which are also incorporated herein by reference in their entirety.

One of the design criteria for the selection of the photosensitive pigment for a charge generator layer and the charge transporting molecule or polymer for a transport layer is that, when light photons photogenerate holes in the pigment, the holes be efficiently injected into the charge transporting moiety in the transport layer. More specifically, the injection efficiency from the pigment to the transport layer should be high. A second design criterion is that the injected holes be transported across the charge transport layer in a short time; shorter than the time duration between the exposure and development stations in an imaging device. The transit time across the transport layer is determined by the charge carrier mobility in the transport layer. The charge carrier mobility is the velocity per unit field and has dimensions of cm2/volt sec. The charge carrier mobility is a function of the structure of the charge transporting moiety, the concentration of the charge transporting moiety in the transport layer and the electrically "inactive" binder polymer in which the charge transport molecule is dispersed (if the transport layer consists of charge transporting molecules dispersed in a binder). It is believed that the injection efficiency can be maximized by choosing a transporting moiety whose ionization potential is lower than that of the pigment (assuming the charge transporting carriers are holes). However, low ionization potential molecules may have other deficiencies, one of which is their instability in an atmosphere of corona effluents. A copy quality defect resulting from the chemical interaction of the surface of the transport layer with corona effluents is referred to as "parking deletion" and is described in detail below.

Photoreceptors are cycled many thousands of times in automatic copiers, duplicators and printers. This cycling causes degradation of the imaging properties of photoreceptors, particularly multilayered organic photoconductors which utilize organic film forming polymers and small molecule low ionization donor material in the charge transport layers. Such wear is accelerated when the photoreceptor is utilized in systems employing abrasive development systems such as single component development systems. Wear is an even greater problem where a drum is utilized which has such a small diameter that it must rotate many, many times merely to form images for each conventional size 8.5 inch by 11 inch document. Wear of the photoreceptor can be compensated by increasing the thickness of the charge transport layer. However, large increases in thickness of the charge transport layer can render the photoreceptor inoperable at high imaging process speeds because of the inadequate (very long) transit times of common charge transport layer materials. Also, large decreases in thickness due to wear can cause dramatic changes in electrical characteristics in only a few thousand cycles that cannot be readily compensated by even sophisticated computerized control apparatus.

When the electrophotographic imaging member is utilized in liquid ink development systems, leaching of small molecules from the charge transport layer into the liquid development can occur. Loss of the small molecule material due to leaching causes undesirable deterioration in electrical properties of the photoreceptor. Also, undesirable crystallization of the small molecule in the charge transport layer can adversely affect the electrical imaging characteristics of the photoreceptor.

Reprographic machines utilizing multilayered organic photoconductors also employ corotrons or scorotrons to charge the photoconductors prior to imagewise exposure. During the operating lifetime of these photoconductors they are subjected to corona effluents which include ozone, various oxides of nitrogen, etc. It is believed that some of these oxides of nitrogen are converted to nitric acid in the presence of water molecules present in the ambient operating atmosphere. The top surface of the photoconductor is exposed to the nitric acid during operation of the machine and charge transporting moiety at the very top surface of the transport layer are converted to what is believed to be the nitrated species of the molecules and these could form an electrically conductive film. However, during operation of the machine, the cleaning subsystem continuously removes (by wear) a region of the top surface thereby preventing accumulation of the conductive species. Unfortunately, such is not the case when the machine is not operating (i.e. in idle mode) between two large copy runs. During the idle mode between long copy runs, a specific segment of the photoreceptor comes to rest (is parked) beneath a corotron that had been in operation during the long copy run. Although the high voltage to the corotron is turned off during the time period when the photoreceptor is parked, some effluents (e.g. nitric acid, etc.) continue to be emitted from the corotron shield, corotron housing, etc. This effluent emission is concentrated in the region of the stationary photoreceptor parked directly underneath the corotron. The effluents render that surface region electrically conductive. When machine operation is resumed for the next copy run, image spreading and loss of resolution occurs in the region of the photoconductor where surface conductivity has increased. Deletion may also be observed in the loss of fine lines and details in the final print. Thus, the corona induced changes primarily occur at the surface region of the charge transport layer. These changes are manifested in the form of increased conductivity which results in loss of resolution of the final toner images. Loss of resolution along the entire imaging surface can occur due to an increase in surface conductance caused by corona species interaction. In the case of excessive increases in conductivity, there can be regions of extreme deletions in the images. This problem is particularly severe in devices employing arylamine charge transport molecules such as N,N'-diphenyl-N,N'-bis(3-methylphenyl)-(1,1'-biphenyl)-4,4'-diamine and charge transport polymers incorporating diamine transporting moiety.

Although, "parking deletion" is described above, in some cases deletion might occur in all portions of the photoconductor. This will depend on the number and type of corotrons employed, the design of the photoconductor cavity and air-flow patterns around the photoconductor.

Thus, although the charge transport moiety meets most other electrophotographic criteria such as being devoid of traps, having high injection efficiency from many pigments, ease in synthesizing, and inexpensive, it encounters serious parking and other deletion problems.

INFORMATION DISCLOSURE STATEMENT

U.S. Pat. No. 4,297,425 to Pai et al., issued Oct. 27, 1981—A layered photosensitive member is disclosed comprising a generator layer and a transport layer containing a combination of diamine and triphenyl methane molecules dispersed in a polymeric binder.

U.S. Pat. No. 4,050,935 to Limburg et al., issued Sep. 27, 1977—A layered photosensitive member is disclosed comprising a generator layer of trigonal selenium and a transport layer of bis(4-diethylamino-2-methylphenyl)phenylmethane molecularly dispersed in a polymeric binder.

U.S. Pat. No. 4,457,994 to Pai et al. et al, issued Jul. 3 1984—A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 to Horgan et al., issued Jul. 28, 1981—An imaging member is disclosed comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,871,634 to Limburg et al., issued Oct. 3, 1989—An electrostatographic imaging member is disclosed which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,515,882 to Mammino et al, issued May 7, 1985—An electrophotographic imaging system is disclosed which utilizes a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

U.S. Pat. No. 4,599,286 to Limburg et al., issued Jul. 8, 1982—An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

In copending application entitled "LAYERED PHOTORECEPTOR STRUCTURES WITH OVERCOATINGS CONTAINING A TRIPHENYL METHANE" Ser. No. 07/997,412, filed on Dec. 28, 1992, refiled as continuation application Ser. No. 08/261,651, now U.S. Pat. No. 5,391,447, an electrophotographic imaging member is disclosed comprising a substrate, a charge generating layer, a charge transport layer comprising charge transporting molecules dispersed in a first polymer binder, and an overcoat layer comprising a triphenyl methane molecule dispersed in a second polymer binder, the second polymer binder being soluble in a solvent in which the first polymer binder is insoluble. The overcoat layer may contain an optional charge transport molecule. The device may also include any suitable optional charge blocking, adhesive and other sub layers. This electrophotographic imaging member is fabricated by forming on a charge generating layer a first coating comprising charge transporting molecules dispersed in a solution of a first polymer binder dissolved in a first solvent, drying the coating to remove the solvent to form a substantially dry charge transport layer, forming on the charge transport layer a second coating comprising triphenyl methane molecules and charge transporting molecules dispersed in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process. The entire disclosure of this copending application is incorporated herein by reference.

In copending application entitled "LAYERED PHOTORECEPTOR WITH OVERCOATINGS CONTAINING HYDROGEN BONDED MATERIALS", Ser. No. 08,172,520 filed concurently herewith on Dec. 21, 1993, now U.S. Pat. No. 5,368,967 an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. The entire disclosure of this copending application is incorporated herein by reference.

In copending application entitled "PHOTORECEPTOR WITH LOW SURFACE ENERGY OVERCOAT", Ser. No. 08/170,480, filed concurently herewith on Dec. 21, 1993, now U.S. Pat. No. 5,438,099, an electrophotographic imaging member is disclosed comprising a substrate, a charge generating layer, a charge transport layer, and an overcoat layer comprising a small molecule hole transporting arylamine having at least two hydroxy functional groups, a hydroxy terminated dimethyl siloxane and a polyamide film forming binder capable of forming hydrogen bonds with the hydroxy functional groups on the hydroxy arylamine and hydroxy diorgano siloxane. This overcoat layer may be fabricated using an alcohol solvent. This electrophotographic imaging member may be utilized in an electrophotographic imaging process. The entire disclosure of this copending application is incorporated herein by reference.

Although acceptable images may be obtained when chemical triphenyl methanes are incorporated within the bulk of the charge transport layers, the photoreceptor can exhibit at least two deficiencies when subjected to extensive cycling. One is that the presence of the triphenyl methane in the bulk of the charge transport layer results in trapping of photoinjected holes from the generator layer into the transport layer giving rise to higher residual potentials. This can cause a condition known as cycle-up in which the residual potential continues to increase with multi-cycle operation. This can give rise to increased densities in the background areas of the final images. A second undesirable effect due to the addition of the triphenyl methane in the bulk of the transport layer is that some of these molecules migrate into the generator layer during the process of the fabrication of the transport layer. The presence of these molecules on the surface of the pigment in the generator layer could result in cyclic instabilities, particularly in long image cycling runs. These two deficiencies limits the concentration of the triphenyl methanes that can be added in the transport layer.

Where photoreceptors are overcoated with films containing triphenyl methanes, intermixing of the overcoat and the transport layers occur which can render the overcoat very ineffective. This intermixing leads to the incorporation of hydroxy triphenyl methanes in the bulk of the transport layer causing cycle-up. Also, the intermixing causes a reduction of the concentration of triphenyl methanes on the outer surface of the photoreceptor. The concentration of triphenyl methanes in the outer surface region of the photoreceptor prevents the aforementioned deletion.

Thus, there is a continuing need for photoreceptors having improved resistance to corona effluent induced deletions without increased densities in the background areas of the final images, migration of additives into the generator layer during fabrication of the transport layer, and cyclic instabilities.

SUMMARY OF THE INVENTION

It is, therefore, an object of the present invention to provide an improved electrophotographic imaging member which overcomes the above-noted deficiencies.

It is another object of the present invention to provide an improved electrophotographic imaging member exhibiting greater resistance to abrasion during image cycling.

It is yet another object of the present invention to provide an improved electrophotographic imaging member that resists leaching of components from the charge transport layer during liquid development.

It is yet another object of the present invention to provide an improved electrophotographic imaging member that resists cracking of the charge transport layer during liquid development.

It is still another object of the present invention to provide an improved electrophotographic imaging member which reduces crystallization of small molecules in the charge transport layer.

It is another object of the present invention to provide an improved electrophotographic imaging member which is stable against copy defects such as print deletion.

It is yet another object of the present invention to provide an improved electrophotographic imaging member having greater stability against corona induced chemical changes.

It is another object of the present invention to provide an improved electrophotographic imaging member which avoids residual charge build up.

It is still another object of the present invention to provide an improved electrophotographic imaging member which is mechanically stronger.

It is yet another object of the present invention to provide an improved electrophotographic imaging member having an overcoating free of phase separation of component materials.

The foregoing objects and others are accomplished in accordance with this invention by providing an electrophotographic imaging member comprising a substrate, a charge generating layer, a charge transport layer, and an overcoat layer comprising a small molecule hole transporting triphenyl methane having at least one hydroxy functional group, and a polyamide film forming binder capable of forming hydrogen bonds with the hydroxy functional groups of the hydroxy triphenyl methane. This overcoat layer may be fabricated using an alcohol solvent. This electrophotographic imaging member may be utilized in an electrophotographic imaging process.

Figure 1:
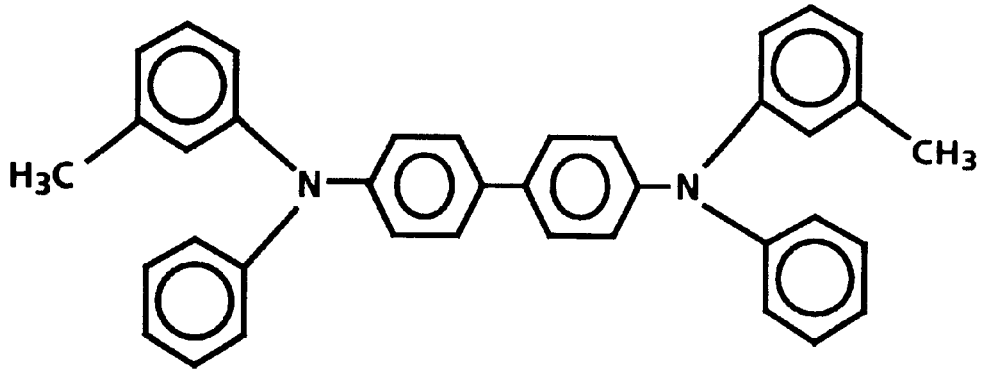
FIG. 1 illustrates a structural formula of an aromatic diamine molecule.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinories, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of molecules by weight, based on the total weight of the layer triphenyl methanes. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine represented by the formula shown in FIG. 1.

Figure 2:
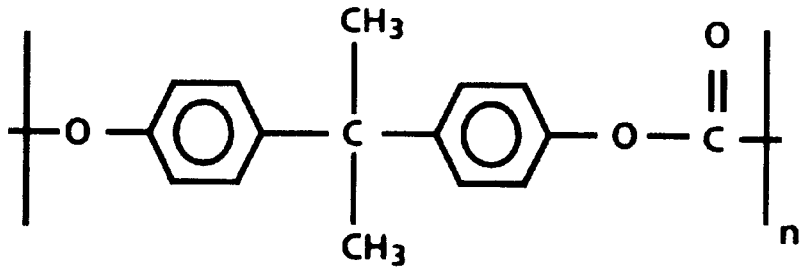
FIG. 2 illustrates a structural formula of a polycarbonate binder segment.
Figure 15:
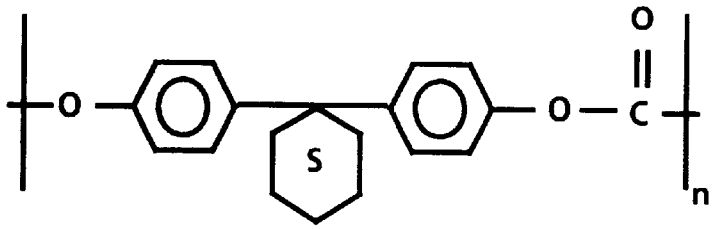
FIG. 15 illustrates a structural formula of a bis phenol Z polycarbonate binder.

The electrically inert polymeric binder generally used to disperse the electrically active molecule in the charge transport layer is a poly(4,4'-isopropylidene-diphenylene) carbonate (also referred to as bisphenol-A-polycarbonate) represented by the formula shown in FIG. 2. The electrically inert polymer binder can also be poly(4,4'-cyclohexylidine-diphenylene) carbonate (referred to as. bisphenol-Z polycarbonate) represented by the formula shown in FIG. 15.

Figure 13:
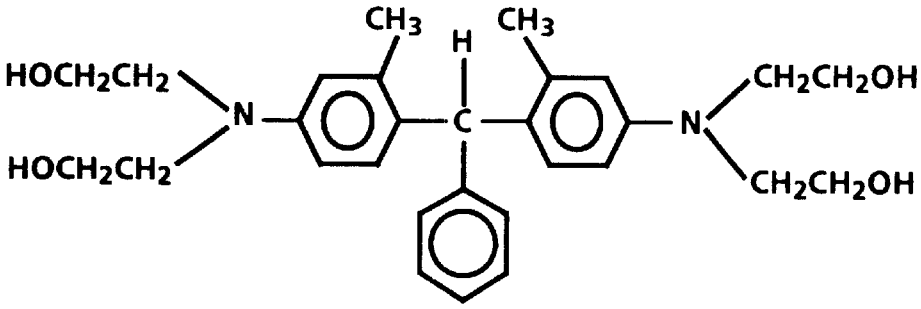
Figure 14:
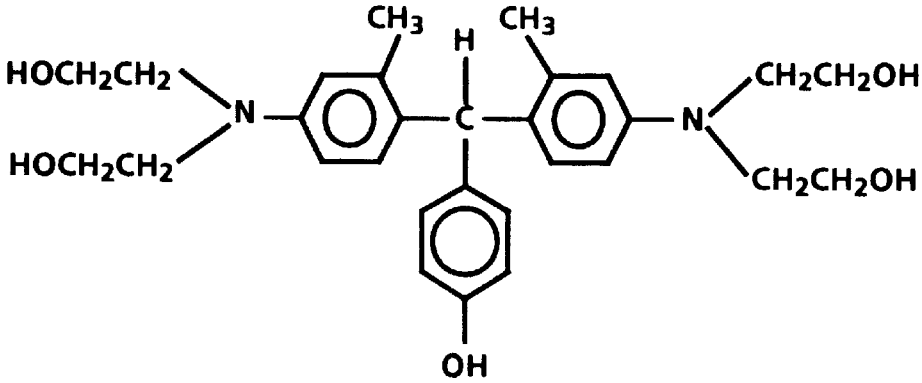
Figure 16:
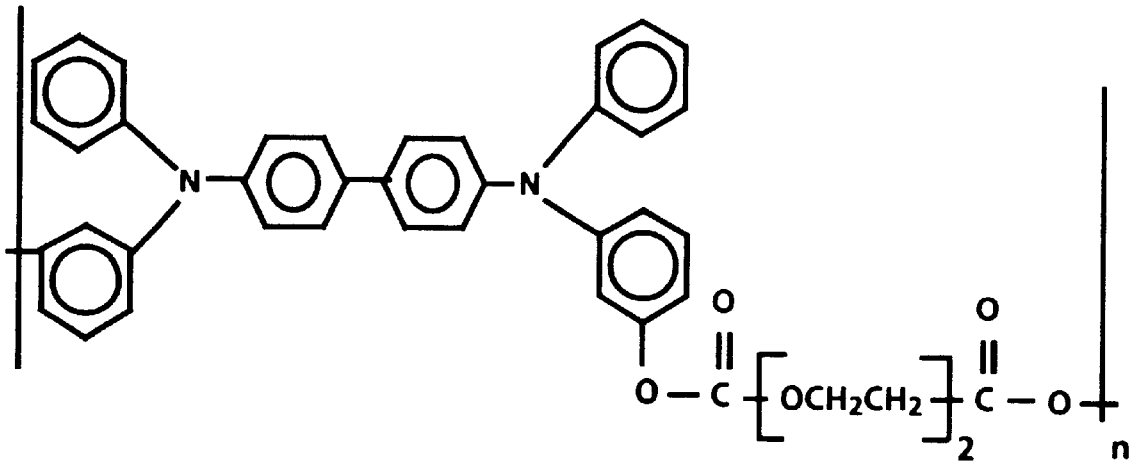
FIG. 16 illustrates a structural formula of a charge transporting polyether carbonate polymer.

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Any suitable charge transporting polymer of the type shown in FIG. 13 may also be utilized in the charge transporting layer of this invention. The charge transporting polymer of the type shown in FIG. 16 is described, for example in U.S. Pat. No. 4,806,443, the entire disclosure thereof being incorporated herein by reference. These electrically active charge transporting polymeric materials should be capable of supporting the injection of photogenerated holes from the charge generation material and incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 5 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

If desired the electrophotographic imaging member of this invention may comprise a supporting substrate, a charge transport layer, charge generating layer and an overcoating layer instead of a supporting substrate, charge generating layer, a charge transport layer and an overcoating layer. Where the charge generating layer overlies the charge transport layer, the components of the charge generating layer should be insoluble in the alcohol solvent employed to apply the overcoat layer of this invention.

The overcoat layer of this invention comprises at least a polyamide film forming binder which is soluble in and coated from alcohol and a hydroxy triphenyl methane monomer which functions as both a stabilizer and as a charge transporting monomer. All the components utilized in the overcoating of this invention should be soluble in a common alcohol solvent. When at least one component in the overcoating mixture is not soluble in the solvent utilized, phase separation can occur which would adversely affect the transparency of the overcoating and electrical performance of the final photoreceptor.

Any suitable alcohol soluble polyamide film forming binder capable for forming hydrogen bonds with hydroxy functional materials may be utilized in the overcoating of this invention. The expression "hydrogen bonding" is defined, as an attractive force or bridge occurring between the polar hydroxy group contained on the triphenyl methane monomer and a hydrogen bonding resin in which a hydrogen atom of the polar hydroxy triphenyl methane monomer is attracted to two unshared electrons of a polyamide resin containing polarizable groups. The hydrogen atom is the positive end of one polar molecule and forms a linkage with the electronegative end of the other polar molecule. The polyamide utilized in the overcoating of this invention should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy triphenyl methane charge transporting monomer. The addition of polyhydroxy triphenyl methane charge transporting monomer minimizes these variations. The polyamide should be capable of dissolving in an alcohol solvent which also dissolves the hole transporting triphenyl methane small molecule having multiple hydroxy functional groups. The polyamide polymers of this invention are characterized by the presence of the amide group —CONH. Polyamides capable of forming a hydrogen bond with compounds having multihydroxy functional groups contain functional groups such as amide. Typical polyamides include the various ELVAMIDE resins which are nylon multipolymer resins, such as the alcohol soluble ELVAMIDE and ELVAMIDE TH resins. Elvamide resins are available from E. I. DuPont Nemours and Company. Other examples of polyamides include ELVAMIDE 8061, ELVAMIDE 8064, ELVAMIDE 8023.

When the overcoat layer contains only polyamide binder material, the layer tends to absorb moisture from the ambient atmosphere and becomes soft and hazy. This adversely affects the electrical properties, the cycling life, and sensitivity of the overcoated photoreceptor.

Figure 3:
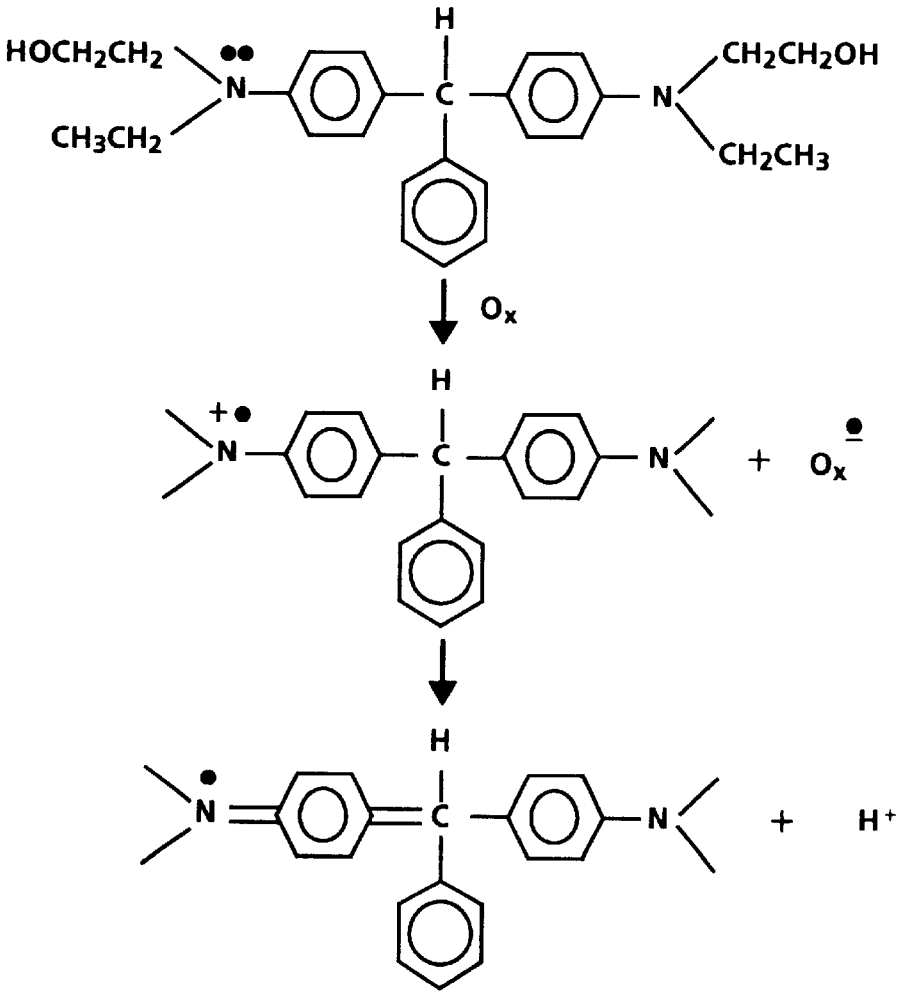
FIG. 3 illustrates electron transfer from a stabilizer to an oxidizing agent.

The overcoating layer of this invention also contains at least one hydroxy triphenyl methane stabilizer/transport material. The hydroxy triphenyl methane stabilizer material should contain at least one hydroxy functional group and, more preferably, at least two hydroxy functional groups. There does not appear to be any limitation as to the maximum number of hydroxy functional groups attached to the hydroxy triphenyl methane stabilizer molecule. The hydroxyl groups attached to the triphenyl methane family of molecules interact so strongly with polyamide binders capable of forming hydrogen bonds that they cannot separate when operated with development systems containing liquid ink. Additionally, these hydroxy triphenyl methane molecules are soluble in alcohol which must also be used as the solvent for the polyamide binder. The presence of hydroxy triphenyl methanes in the overcoat increases its stability against deletion compared to overcoats containing only the hydroxy arylamine and polyamide binder. The overcoat composition of hydroxy triphenyl methane and polyamide provides sufficient charge transport capabilities to the overcoat to prevent residual build up and improved stability against corona induced chemical changes. Although the precise nature for stabilization to the oxidizing environment of corona is not known, it is believed that the stabilization mechanism may initially involve an electron transfer from the stabilizer to the oxidizing agent, herein referred to as Ox, followed by a disproportion reaction of the triphenyl methane moiety. An example this is illustrated in FIG. 3.

Figure 4:
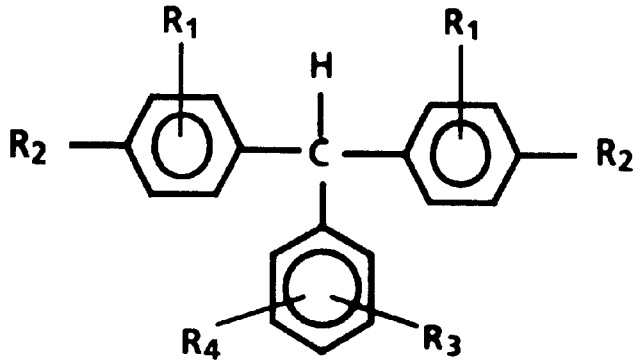
FIG. 4 illustrates a generic structural formula for hydroxy triphenyl methane.

Hydroxy triphenyl methane stabilizer molecules of this invention is represented by the generic formula shown in FIG. 4 wherein $R_1$, $R_2$, $R_3$, and $R_4$, are independently selected from the group consisting of:

$$-CH_3,\ -H,\ -OH,\ -N(CH_2CH_3),$$

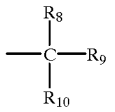

wherein $R_8$, and $R_9$ and $R_{10}$ are independently selected from $H-(CH_2-)n'''CH_3$ wherein n''' is an integer from 0 to 6,

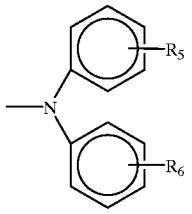

wherein $R_5$ and $R_6$ are independently selected from the group consisting of $H-(CH_2)_{n''''}CH_3$ wherein n'''' is an integer from 0 to 6,

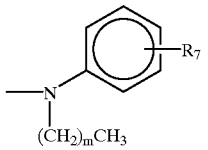

wherein $R_7$ is independently selected from $H-(CH_2)_{n'''''}CH_3$ wherein n''''' and m are an integer from 0 to 6, $$-N(CH_3)CH_2CH_2OH,\ -N(CH_2)_nCH_3(CH_2)_nOH$$

wherein n is an integer from 0 to 6 and n' is an integer from 1 to 6 and, $$—N[(CH_2)n''CH_2OH]_2$$

wherein n" is an integer from 0 to 6, wherein at least one or more of $R_1$, $R_2$, $R_3$, or $R_4$ must contain at least one hydroxy group, and wherein at least one or more of $R_1$, $R_2$, $R_3$, or $R_4$ must contain at least one amino group.

Figure 5:
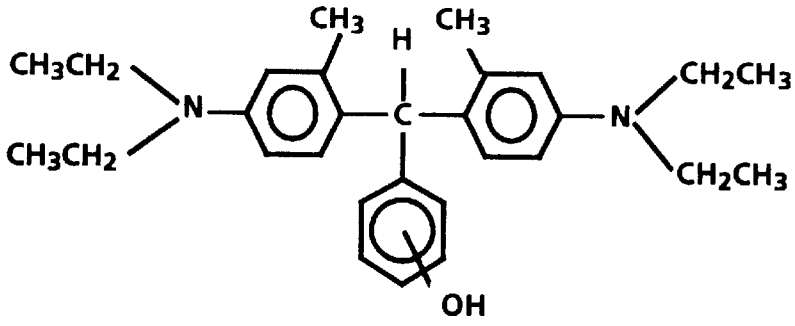
FIGS. 5–14 illustrate structural formulae of hydroxy triphenyl methane charge transport molecules.
Figure 6:
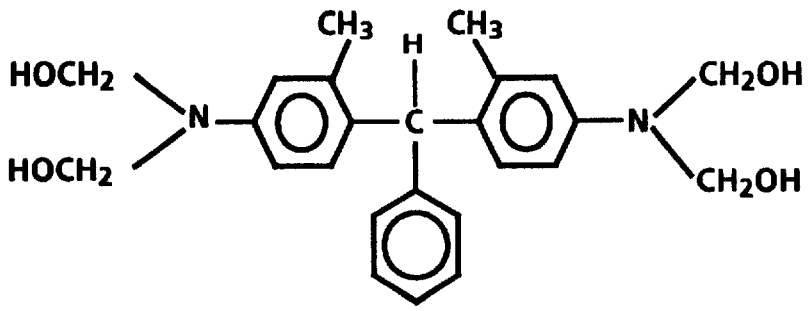
Figure 7:
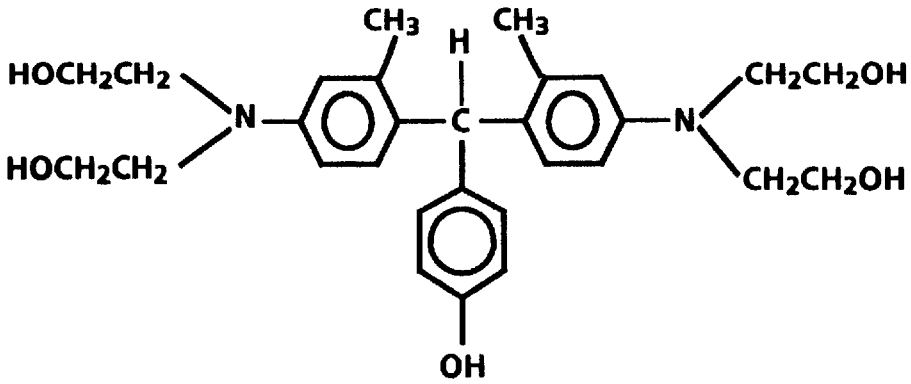
Figure 8:
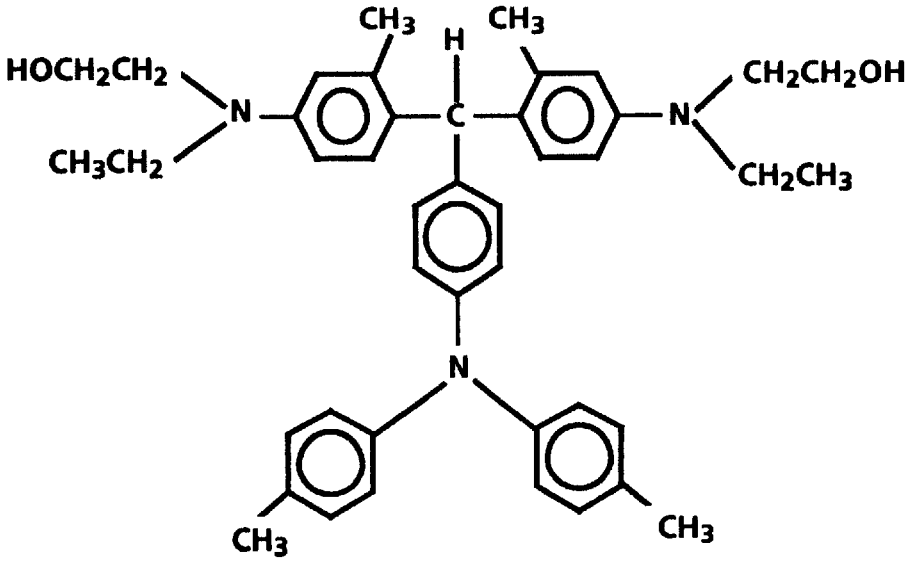
Figure 9:
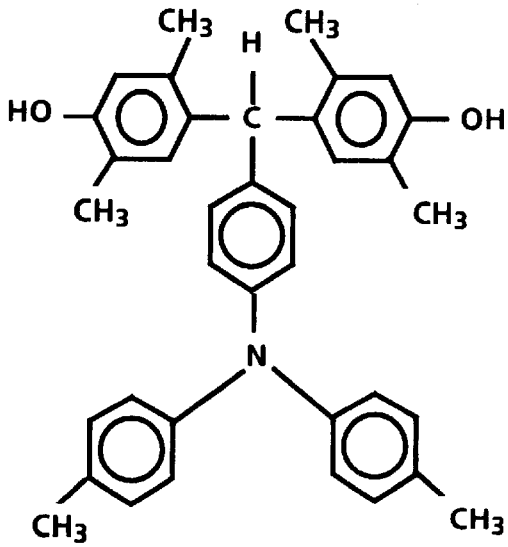
Figure 10:
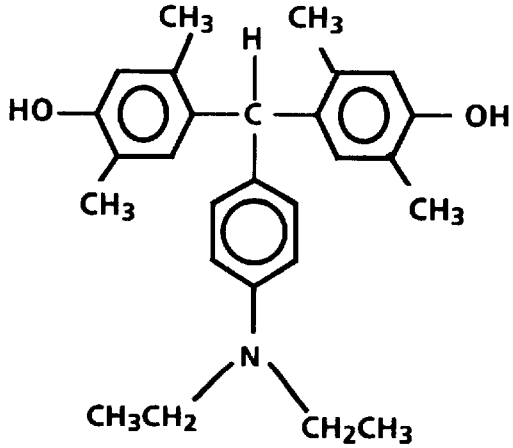

Typical hydroxy triphenyl methane stabilizer molecules are represented by the formulae in FIGS. 5 through 14. A species represented by the formula shown in FIG. 5 is, for example, bis-(4-diethylamino-2-methyl phenyl)-4-hydroxy phenyl methane.

Any suitable alcohol may be employed to apply the overcoating composition of this invention. The alcohol selected should dissolve the hydroxy triphenylmethane and the polyamide utilized in the overcoating layer. The alcohol solvent should not dissolve any binder in the underlying layer. The use of an alcohol solvent minimizes the impact of the coating process on the environment. The alcohol should contain at least one hydroxy functional group per molecule. Typical alcohols containing at least one hydroxy functional group per molecule include, for example, isopropanol, methanol, ethanol, butanol, n-propanol, and the like. Alcohols with more than one hydroxy group per molecule include, for example, glycol, and the like. Satisfactory results may be achieved when the amount of alcohol utilized is between about 99 percent by weight and about 70 percent by weight based on the total weight of the coating composition. Generally, the optimum amount of alcohol utilized depends upon the particular type of coating process utilized to apply the overcoating material.

The concentration of the hydroxy triphenyl methane molecule in the overcoat layer is preferably between about 5 percent and about 50 percent by weight based on the total weight of the dried overcoat, the remainder normally being the polyamide binder. The concentration of the polyamide in the overcoat layer may be between about 95 percent and about 5 percent by weight based on the total weight of the overcoat after drying. When less than about 5 percent by weight of hydroxy triphenyl methane molecule is present in the overcoat, the charge transport through the overcoat slows down resulting in higher residuals. When the proportion of hydroxy triphenylmethane small molecule charge transport material in the overcoating layer is greater than about 50 percent by weight based on the total weight of the overcoating layer, increases in residual voltages can be seen with long term cycling. In addition, mechanical and abrasive wear properties can be negatively impacted.

Any suitable coating technique may be utilized to form the overcoating layer. Typical coating techniques include spraying, extrusion coating, roll coating, veneer coating, dip coating, slide coating, slot coating, wire wound rod coating, and the like.

Any suitable technique may be utilized to dry the overcoating. Typical drying techniques include oven drying, forced air oven drying, radiant heat drying, and the like.

The thickness of the dried overcoat layer should be uniform and continuous. It can range in thickness from a mono molecular thickness up to a maximum thickness of about 10 micrometers. Generally, thicker coatings may be utilized for slower electrophotographic copier and printers.

If desired, the outer surface of the overcoating layer may be imparted with a texture to minimize the formation of moray patterns. The texture may be achieved by any suitable means such as embossing, regulation of drying conditions, and the like.

Generally, when large amounts of a charge transporting molecule material is added to an overcoating layer, the strength of the overcoating layer is reduced. Surprisingly, the overcoating layer of this invention becomes tougher when large amounts of small molecule triphenyl methane charge transport material having at least one, but preferably two hydroxy functional groups are incorporated into the overcoating layer of this invention. When triphenyl methane charge transport material having at least two hydroxy functional groups are blended with polyamide binder capable of hydrogen bonding to achieve hydrogen bonding, the combination of materials restricts the absorption of atmospheric moisture into the polyamide polymer thereby eliminating the plasticizing effect of the water. Moisture tends to lessen overcoating abrasion and wear resistance when the overcoating contains only the polyamide. Unlike coatings containing small molecule charge transport material dissolved or molecularly dispersed in polycarbonate binder, the hydrogen bonded overcoat layer is compositionally stable and does not phase separate even when exposed to liquid ink media.

The film forming binder for the transport layer should not dissolve in the alcohol solvent selected for the overcoating layer. For example, charge transport layer binders such as polycarbonates do not dissolve in alcohol. Thus, for example, poly(4,4'-isopropylidene-diphenylene)carbonate (i.e. bisphenol-A-polycarbonate) shown in FIG. 2 or poly (4,4'-cyclohexylidine-diphenylene) carbonate (also referred to as bisphenol-Z-polycarbonate), having a structure represented by the formula shown in FIG. 15, do not dissolve in alcohols such as isopropanol, methanol, and the like. Bisphenol-A-polycarbonate dissolves in methylene chloride and bisphenol-Z-polycarbonate is soluble in toluene. Other polymers insoluble in alcohols include, for example polystyrene, and the like. The expression "soluble" as employed herein is defined as capable of forming a solution with which a film can be applied to a surface and dried to form a continuous coating. The expression "insoluble" as employed herein is defined as not capable of forming a solution so that the solvent and the solid remain in two separate phases and a continuous coating cannot be formed. Molecular weights of the polymers can vary, for example, from about 20,000 to about 150,000.

The composition and materials employed in the overcoat layer must meet several requirements: (1) it should be charge transporting to prevent a residual build up across the overcoat, and (2) it should not intermix into the charge transport layer during the process of fabricating the overcoat and (3) it should have hydroxy groups in order to facilitate hydrogen bonding with polyamides. The second requirement can be met by the judicious selection of binders for the charge transport layer and the overcoat layers whereby the polymer binder for the overcoat is soluble in a solvent in which the polymer binder for the charge transport layer is insoluble.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The photoreceptor of this invention may be used in any conventional electrophotographic imaging system. As described above, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once.

A number of examples are set forth hereinbelow and are illustrative of different compositions and conditions that can be utilized in practicing the invention. All proportions are by weight unless otherwise indicated. It will be apparent, however,that the invention can be practiced with many types of compositions and can have many different uses in accordance with the disclosure above and as pointed out hereinafter.

Test Procedures Utilized in Following Examples

Scanner Characterization

Each photoconductor device to be evaluated is mounted on a cylindrical aluminum drum substrate which is rotated on a shaft. The device is charged by a corotron mounted along the periphery of the drum. The surface potential is measured as a function of time by capacitively coupled voltage probes placed at different locations around the shaft. The probes are calibrated by applying known potentials to the drum substrate. The devices on the drums are exposed by a light source located at a position near the drum downstream from the corotron. As the drum is rotated, the initial (pre-exposure) charging potential is measured by voltage probe 1. Further rotation leads to the exposure station, where the photoconductor device is exposed to monochromatic radiation of known intensity. The device is erased by light source located at a position upstream of charging. The measurements made include charging of the photoconductor device in a constant current or voltage mode. The device is charged to a negative polarity corona. As the drum is rotated, the initial charging potential is measured by voltage probe 1. Further rotation leads to the exposure station, where the photoconductor device is exposed to monochromatic radiation of known intensity. The surface potential after exposure is measured by voltage probes 2 and 3. The device is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a function of light exposure. The charge acceptance and dark decay can also be measured in the scanner.

Parking Deletion Test

A negative corotron is operated (with high voltage connected to the corotron wire) opposite a grounded electrode for several hours. The high voltage was turned off, and the corotron was placed (or parked) for five to ten minutes on a segment of the photoconductor device being tested. Only a short middle segment of the device was thus exposed to the corotron effluents. Unexposed regions on either side of the exposed regions were used as controls. The photoconductor device was then tested in a scanner for positive charging properties for systems employing donor type molecules. These systems were operated with negative polarity corotron in the latent image formation step. An electrically conductive surface region (excess hole concentration) appeared as a loss of positive charge acceptance or increased dark decay in the exposed regions (compared to the unexposed control areas on either side of the short middle segment) Since the electrically conductive region was located on the surface of the device, a negative charge acceptance scan was not affected by the corotron effluent exposure (negative charges do not move through a charge transport layer made up of donor molecules). However, the excess carriers on the surface cause surface conductivity results in loss of image resolution and, in severe cases, causes deletion. The loss of positive charge acceptance is a measure of deletion with higher loss causing more deletion.

EXAMPLE 1

Four electrophotographic imaging members were prepared by forming coatings using conventional coating techniques on a substrate comprising a vacuum deposited titanium layer on a polyethylene terephthalate film (MELINEX®, available from ICI). The first applied coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, followed by curing for 10 minutes at 110 degree centigrade in a forced air oven. The second coating was an adhesive layer of polyester resin (49,000, available from E. I. duPont de Nemours & Co.) having a thickness of 0.005 micrometer (50 Angstroms) and was coated as follows: 0.5 gram of 49,000 polyester resin was dissolved in 70 grams of tetrahydrofuran and 29.5 grams of cyclohexanone. The film was coated by a 0.5 mil bar and cured in a forced air oven for 10 minutes. The next coating was a charge generator layer containing 35 percent by weight vanadyl phthalocyanine particles obtained by the process as disclosed in U.S. Pat. No. 4,771,133 to Liebermann et al., issued Sept. 13, 1988, dispersed in a polyester resin (VITEL PE100, available from Goodyear Tire and Rubber Co.) having a thickness of 1 micrometer.

EXAMPLE 2

The generator layers of two of the imaging members of Example 1 were coated with a transport layer formed with a solution containing 9 grams of N,N'-diphenyl-N,N'-bis(3-methyl-phenyl)-(1,1'biphenyl)-4,4'-diamine and 9 grams of polycarbonate resin [poly(4,4'-isopropylidene-diphenylene carbonate, available as MAKROLON R from Farbenfabricken Bayer A. G.], dissolved in 102 grams of methylene chloride solvent using a 3 mil bar. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. The coated devices were dried at 80° C. for 30 minutes in a forced air oven to form a 25 micrometer thick transport layer.

EXAMPLE 3

The generator layers of two of the imaging members of Example 1 were coated with a 25 micrometer thick transport layer of polyether carbonate. The polyether carbonate resin (structure shown in FIG. 16) was prepared as described in Example III of U.S. Pat. No. 4,806,443. It was accomplished by dissolving one gram of the polymer into nine grams of methylene chloride and coating a 25 micrometer film with bar coating. The films were dried in a forced air oven at 100° C. for 20 minutes.

EXAMPLE 4

Figure 11:
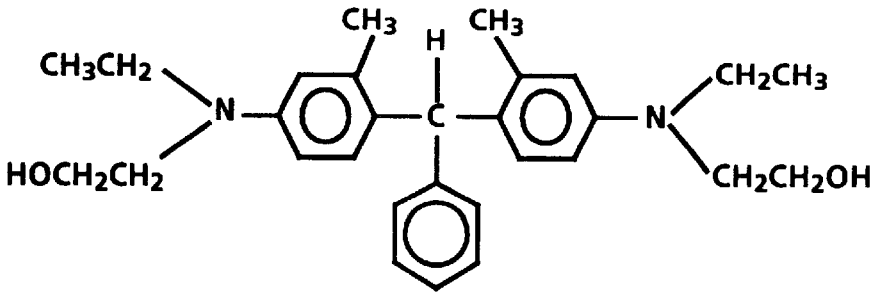
Figure 12:
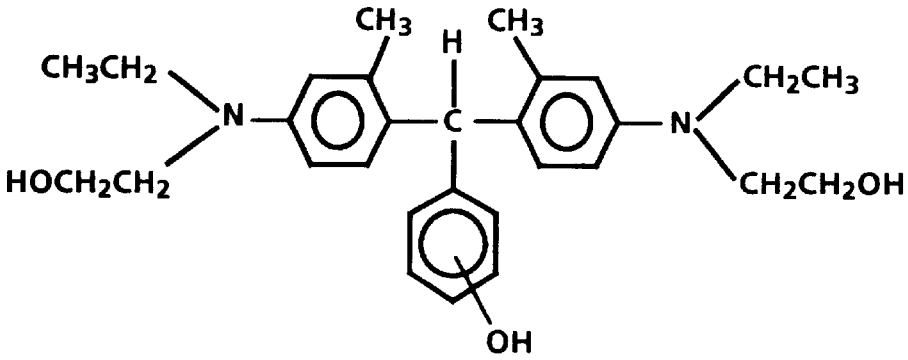

One of the photoreceptor samples of Example 2 was coated with an overcoat of 50 percent by weight polyamide by dissolving 1 gram of ELVAMIDE 8061 (available from duPont de Nemours & Co.) and 1 gram of bis-(4-(beta-hydroxyethyl ethylamino)-2-methylphenyl)phenylmethane (a dihydroxy triphenyl methane, the structure of which is shown in FIG. 11) in 8 grams of methanol and 8 grams of propanol. The coated device was dried for 30 minutes by ramping the temperature between 35° C. and 100° C. in a forced air oven to form a 2–3 micrometer thick overcoat layer. This device was labeled #1.

The second of the photoreceptor samples of Example 2 was coated with an overcoat of 50 percent by weight polyamide by dissolving 1 gram of ELVAMIDE 8061 (available from duPont de Nemours & Co.) and 1 gram of N,N'-diphenyl-N,N'-bis(3-hydroxyphenyl)-[1,1'-biphenyl]-4,4'-diamine (a dihydroxy arylamine of prior art) in 8 grams of methanol and 8 grams of propanol. The coated device was dried 30 minutes by ramping the temperature between 35° C. and 100° C. in a forced air oven to form a 2–3 micrometer thick overcoat layer. This device was labeled #2.

EXAMPLE 5

One of the photoreceptor samples of Example 3 was coated with an overcoat of 50 percent by weight polyamide by dissolving 1 gram of ELVAMIDE 8061 (available from duPont de Nemours & Co.) and 1 gram of bis-(4-(beta-hydroxyethyl ethylamino)-2-methylphenyl)phenylmethane (a dihydroxy triphenyl methane, the structure of which is shown in FIG. 11) in 8 grams of methanol and 8 grams of propanol. The coated device was dried 30 minutes by ramping the temperature between 35° C. and 100° C. in a forced air oven to form a 2–3 micrometer thick overcoat layer. This device was labeled #3.

The second of the photoreceptor samples of Example 3 was coated with an overcoat of 50 percent by weight polyamide by dissolving 1 gram of ELVAMIDE 8061 (available from duPont de Nemours & Co.) and 1 gram of N,N'-diphenyl-N,N'-bis(3-hydroxyphenyl)-[1,1'-biphenyl]-4,4'-diamine (a dihydroxy arylamine of prior art) in 8 grams of methanol and 8 grams of propanol. The coated device was dried 30 minutes by ramping the temperature between 35° C. and 100° C. in a forced air oven to form a 2–3 micrometer thick overcoat layer. This device was labeled #4.

EXAMPLE 6

Devices #1, 2 ,3 and 4 were tested in a scanner. The Photo-Induced Discharge (PIDC) characteristics of devices #1 and 2 were equivalent to each other. The Photo-Induced Discharge (PIDC) characteristics of devices #3 and 4 were equivalent to each other.

EXAMPLE 7

Devices #1, 2 ,3 and 4 were subjected to the "Parking Deletion Test" described above. Before exposure to corona charging, the positive potential on all four photoreceptors were essentially equivalent (800 V). After corona exposure for 10 minutes, Devices 2 and 4 (prior art) showed deletion with a loss of positive potential (400V) in the center region of the samples whereas Devices 1 and 3 (devices of the present invention) showed essentially no deletion (no loss of positive potential). In addition, the sample overcoated with polyamide and dihydroxy arylamine also showed loss of potential on the regions bordering each side of the exposed region. This demonstrates the sensitivity of the polyamide and dihydroxy arylamine surface (as compared to the non-overcoated control sample) to corona effluents that diffuse on either side of the parked corotron. The device overcoated with polyamide and bis-(4-(beta-hydroxyethyl ethylamino)-2-methylphenyl)phenylmethane of the present invention showed no deletion. Later, 14 hours after exposure, the sample overcoated with polyamide and dihydroxy arylamine still exhibited some deletion in the parking deletion test.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a charge generating layer, a charge transport layer, and an overcoat layer comprising a hydroxy triphenyl methane having at least one hydroxy functional group and a polyamide film forming binder capable of forming hydrogen bonds with said hydroxy functional group of said hydroxy triphenyl methane molecule, said charge transport layer being substantially free of triphenyl methane molecules.

2. An electrophotographic imaging member according to claim 1 wherein said hydroxy triphenyl methane is represented by the following structural formula:

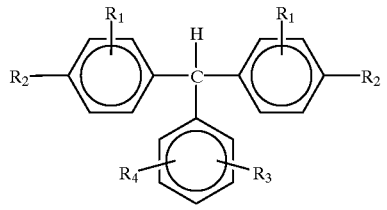

wherein $R_1$, $R_2$, $R_3$, and $R_4$, are independently selected from the group consisting of:

$—CH_3$, —H, —OH, $—N(CH_2CH_3)$,

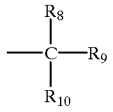

wherein $R_8$, $R_9$ and $R_{10}$ are independently selected from H, $—(CH_2—)n'''CH_3$ wherein n''' is an integer from 0 to 6,

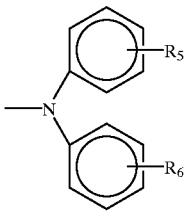

wherein $R_5$ and $R_6$ are independently selected from the group consisting of H, and —$(CH_2)_{n''''}CH_3$ wherein n''''is an integer from 0 to 6,

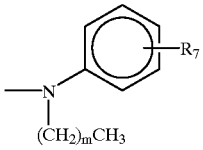

wherein $R_7$ is independently selected from H, or —$(CH_2)_{n'''''}CH_3$ wherein n'''''and m are an integer from 0 to 6, —$N(CH_3)CH_2CH_2OH$, —$N(CH_2)_nCH_3(CH_2)_nOH$ wherein n is an integer from 0 to 6 and n' is an integer from 1 to 6, and —$N[(CH_2)n''CH_2OH]_2$ wherein n'' is an integer from 0 to 6, wherein at least one or more of $R_1$, $R_2$, $R_3$, or $R_4$ must contain at least one hydroxy group, and wherein at least one or more of $R_1$, $R_2$, $R_3$, or $R_4$ must contain at least one amino group.

3. An electrophotographic imaging member according to claim 2 wherein said hydroxy triphenyl methane is bis-(4-diethylamino-2-methyl phenyl)-4-hydroxy phenyl methane.

4. An electrophotographic imaging member according to claim 1 wherein said polyamide film forming binder contains —CONH groups capable of forming hydrogen bonds with said hydroxy functional groups of said hydroxy triphenyl methane compound.

5. An electrophotographic imaging member according to claim 1 wherein the concentration of said hydroxy triphenyl methane molecule in said overcoat layer is between about 5 percent and about 50 percent by weight based on the total weight of said overcoat after drying.

6. An electrophotographic imaging member according to claim 1 wherein the concentration of said polyamide in said overcoat layer is between about 95 percent and about 5 percent by weight based on the total weight of said overcoat after drying.

7. An electrophotographic imaging member according to claim 1 wherein said charge transport layer is between said charge generation layer and said overcoat.

8. An electrophotographic imaging member according to claim 1 wherein said charge transport layer comprises electrically active charge transporting molecules dissolved or molecularly dispersed in an electrically inactive polymer binder which is insoluble in alcohol.

9. An electrophotographic imaging member according to claim 1 wherein said charge transport layer comprises less than about two percent of said triphenyl methane molecules based on the weight of said charge transport layer.

10. An electrophotographic imaging member according to claim 1 wherein said charge transport layer comprises electrically active charge transporting polymer which is insoluble in alcohol.

11. An electrophotographic imaging member according to claim 1 wherein said overcoat layer is a uniform continuous layer having a thickness up to 10 micrometers.

12. An electrophotographic imaging member according to claim 1 wherein said charge transport layer has a thickness of between about 5 micrometers and about 50 micrometers.

13. An electrophotographic imaging member according to claim 1 wherein said hydroxy triphenyl methane has at least two hydroxy functional groups.

14. An electrophotographic imaging member comprising a substrate, a charge generating layer, a charge transport layer, and an overcoat layer comprising bis-(4-(beta-hydroxyethylethylamino)-2-methylphenyl)-phenylmethane having hydroxy functional groups and a polyamide film forming binder capable of forming hydrogen bonds with said hydroxy functional groups, said charge transport layer being substantially free of triphenyl methane molecules.

15. A process for fabricating an electrophotographic imaging member comprising providing a substrate coated with a charge generating layer and a charge transport layer comprising charge transporting molecules dispersed in a solution of an alcohol insoluble polymer binder or a charge transporting polymer which is insoluble in alcohol, forming on said charge transport layer a coating of a solution consisting essentially of a hydroxy triphenyl methane compound having at least one hydroxy functional group and a polyamide film forming binder capable of forming hydrogen bonds with said hydroxy functional groups of said hydroxy triphenyl methane compound dissolved in an alcohol solvent, and drying said coating to remove said alcohol solvent to form a dry overcoat layer consisting essentially of said hydroxy triphenyl methane compound and said polyamide film forming binder, said charge transport layer being substantially free of triphenyl methane molecules.

* * * * *